US008641321B2

(12) United States Patent
Eul et al.

(10) Patent No.: US 8,641,321 B2
(45) Date of Patent: Feb. 4, 2014

(54) ROAD FINISHING MACHINE

(71) Applicant: Joseph Vogele AG, Ludwigshafen/Rhein (DE)

(72) Inventors: Achim Eul, Mannheim (DE); Roman Munz, Neustadt (DE); Martin Buschmann, Neustadt (DE)

(73) Assignee: Joseph Vogele AG, Ludwigshafen/Rhein (DE)

( * ) Notice: Subject to any disclaimer, the term of this patent is extended or adjusted under 35 U.S.C. 154(b) by 0 days.

(21) Appl. No.: 13/677,789

(22) Filed: Nov. 15, 2012

(65) Prior Publication Data

US 2013/0142572 A1 Jun. 6, 2013

(30) Foreign Application Priority Data

Dec. 1, 2011 (EP) ..... 11009536

(51) Int. Cl.
*E01C 19/22* (2006.01)

(52) U.S. Cl.
USPC ..... 404/118

(58) Field of Classification Search
USPC ..... 404/84.1, 114, 118
See application file for complete search history.

(56) References Cited

U.S. PATENT DOCUMENTS

| | | | | |
|---|---|---|---|---|
| 3,613,530 | A * | 10/1971 | Hess | 404/84.2 |
| 5,356,238 | A * | 10/1994 | Musil et al. | 404/84.1 |
| 5,362,176 | A | 11/1994 | Sovik | |
| 8,353,642 | B2 * | 1/2013 | Munz et al. | 404/118 |
| 2011/0091278 | A1 | 4/2011 | Munz et al. | |
| 2011/0123267 | A1 * | 5/2011 | Buschmann et al. | 404/72 |
| 2012/0031724 | A1 * | 2/2012 | Noll et al. | 192/31 |

FOREIGN PATENT DOCUMENTS

| | | | |
|---|---|---|---|
| EP | 2325390 | B1 | 5/2012 |
| WO | 2010115710 | A2 | 10/2010 |

OTHER PUBLICATIONS

European Search Report mailed Jun. 26, 2012, which issued in corresponding EP application No. 11009536.1.

* cited by examiner

*Primary Examiner* — Gary Hartmann
(74) *Attorney, Agent, or Firm* — Fish & Richardson P.C.

(57) ABSTRACT

A road finishing machine having an extendable screed and including an actuation instrument manually movable by the operator for adjusting the speed of a hydraulic movement actuator of the extendable screed.

19 Claims, 2 Drawing Sheets

ROAD FINISHING MACHINE

FIELD OF THE INVENTION

The invention relates to a road finishing machine having at least one hydraulically movable extendable screed part, an electronic control device, and at least one control panel linked to the control device

BACKGROUND OF THE INVENTION

In the road finishing machine disclosed in EP 2 325 390 A, hydraulic proportional valve technology is employed for moving each extendable screed part to be able to vary the moving speed as required and optionally load-independently if in the laying operation a neat peripheral edge adjustment in the surfacing is required or an obstacle must be driven around without any noteworthy change of the laying travel speed of the road finishing machine. Using proportional valve technology, the speed of the movement actuator can in principle be continuously varied because the proportional magnet adjusts the amount of hydraulic oil that determines speed in response to the value of the control current. The control of the proportional magnet is suitably placed in one external control stand each at the screed, e.g. at the extendable screed part, so that it can be correspondingly handled by an operator who is standing on a platform at the screed and driving along or who is walking next to the screed with visual inspection of the external end of the extendable screed part. While proportional valve technology for the movement actuators of the extendable screed parts promises a considerable improvement in the surfacing quality, unexpected problems occur in practice resulting, among other things, from operational vibrations of the control and/or the relative movements between the accompanying operator and the external control stand and aggravating a sensible and precise handling of the control and thus the speed control of the extendable screed part.

U.S. Pat. No. 5,362,176 A, discloses a road finishing machine in which the movement actuators of the extendable screed parts are not hydraulically controlled by proportional valve technology but by black-and-white valve technology, i.e. where only On/Off-speed control at a constant moving speed is possible. For example, an automatic system is provided for a neat edge adjustment of the laid surfacing. The system operates with ground scanning sensors and a timing/delay control section with two control relays. Depending on the signals of the ground scanning sensors, a control relay is excited which automatically adjusts the control current for the black-and-white magnet of the respective movement actuator. Since the movement actuator can only drive at one speed, the laying travel speed of the road finishing machine must be correspondingly varied for a neat adjustment or when driving around obstacles, optionally involving losses in the surfacing quality.

SUMMARY OF THE INVENTION

The object underlying the present invention is to provide a road finishing machine having proportional valve technology in the screed which is better suited and easier to handle in pavement laying operations.

The object is achieved with a road finishing machine having the features of the present invention.

According to the present invention the actuation instrument of the control generates an increase or reduction of kinetic resistance noticeable by the operator at least once within the movement path. This signals either a predetermined speed or a transition between two different speeds of the movement actuator of the extendable screed part. Thus, the operator is immediately informed, independent of operational vibrations of the actuation instrument and/or relative movements between the operator and the actuation instrument, and without having a look at the actuation instrument, that he either has not yet reached or has already reached a predetermined speed of the movement actuator, or that he has not yet reached or already reached a transition between two different speeds of the movement actuator. Thus, the operator is afforded better utilization of proportional valve technology in the laying operation in a tactile way and a user-friendly manner. The operator will know for how long and that the movement actuator operates at a lower speed or within a low speed range, and he will sense when the movement actuator operates at a higher speed or within a higher speed range, and he can therefore better adapt the handling of the actuation instrument to the operational situations, for example to effect a neat peripheral edge adjustment and/or drive around an obstacle without necessarily having to vary the laying travel speed of the road finishing machine for this. Of course, several increases in kinetic resistance can be generated over the movement path of the actuation instrument, so that the movement path is subdivided into individual sections registered by the operator in a tactile way. In the simplest case, the movement actuator drives at one speed until the respective increase in kinetic resistance is generated, and after the increase in kinetic resistance is exceeded, it will drive at a second, higher speed. This is sufficient for most of the operating situations in the laying operation. As an alternative, the speed of the movement actuator can of course be continuously increased until the increase in kinetic resistance is generated, and even after the increase in kinetic resistance, it can be still continuously increased, or vice-versa. After the operation of the actuation instrument in the opposite direction of motion, the actuation instrument will generate the inverse effect which the operator will perceive as a clearly noticeable reduction in kinetic resistance signaling him that he has transitioned from a higher speed range to a lower speed range.

In one suitable embodiment, the actuation instrument is equipped with at least one mechanical progressive locking device. The locking device can generate an increase in kinetic resistance or a reduction in kinetic resistance, or several ones within the movement path. It is even conceivable to divide the movement path into several partial sections that are clearly noticeable, e.g. even by locked positions.

In one suitable embodiment, the actuation instrument is a rotary knob which the operator rotates between a zero position and a maximum position over a predetermined movement path. This is an ergonomically advantageous and logical solution. The rotary knob performs a linear change of speed, or a change of speed according to a predetermined regularity, or it digitally divides the rotational path into at least two speed ranges.

In other suitable embodiments, the actuation instrument could be a slide or a joystick or a push-button which also signals information to the operator in a tactile way for user-friendly handling.

In one suitable embodiment, the value and/or position of the at least one noticeable increase in kinetic resistance of the actuation instrument can be adjusted within the movement path. In this manner, an adjustment to different laying conditions can be effected.

In a structurally simple and fail-safe manner, the progressive locking device includes at least two double-leg springs acting in an overlapping or successive manner. This solution is particularly suitable when the actuation instrument is a rotary knob. During handling, the double-leg springs can be tensioned or relieved increasingly, and so-to-speak with a clearly noticeable pressure point, and define one or several spring stages.

It is particularly suitable for the actuation instrument to be self-locking over its movement path, i.e. it automatically maintain any position adjusted by the operator.

As in laying operation practice, it is sufficient for most of the surfacing demands to be able to adjust at least two speed ranges of the movement actuator by utilizing proportional valve technology, in a suitable embodiment, a constant control current of a first value can be adjusted until the noticeable increase in kinetic resistance is reached, and a constant higher control current of a second value can be adjusted when or after the increase in kinetic resistance is reached. Here, the second value should preferably be adjusted such that it corresponds to the maximum speed of the movement actuator. The first value can be selected such that e.g. an only very low speed of the movement actuator is adjusted.

In an alternative embodiment, the value of the control current is varied within the movement path of the actuation instrument linearly or according to a predetermined curve, so that the speed of the movement actuator can be continuously varied. Here, too, at least one increase in kinetic resistance can be generated, or even several ones are generated within the movement range, and the increases in kinetic resistance can even be locked positions.

In one suitable embodiment, at least one external control stand with a control panel is provided at the screed or extendable screed, and the actuation instrument is disposed in the control panel of the external control stand and preferably linked with the control device in the driver stand of the road finishing machine. Adjustment of the extendable screed part here may be executed by an operator standing on the external control stand while simultaneously visually observing the outer end of the extendable screed part. This, however, should not exclude to also provide corresponding noticeably signaling actuation instruments for the extendable screed parts in the driver stand. The principle according to the invention is moreover not only suited for screeds with two extendable screed parts each adjustable by a movement actuator, but also for screeds with extendable screed parts which are each telescopically subdivided with several movement actuators, also independent of whether the extendable screed parts are mounted at the rear or front side of a basic screed, seen in the working drive direction (front-mount, rear-mount).

In one suitable embodiment, one external control stand is disposed externally directly at each extendable screed part, wherein preferably the control panel of the external control stand comprises an actuation instrument only for the movement actuator of the extendable screed part allocated to the external control stand. At each external control stand, thus only the corresponding extendable screed part can be adjusted.

In this connection, it might be suitable, mainly for ergonomic reasons, for the directions of motion of the two actuation instruments at the external control stands to be opposed with respect to the center of the screed, for example such that the rotary knob at the right external control stand controls the extending motion of the right extendable screed part clockwise, while the rotary knob at the left external control stand controls the extending motion of the left extendable screed part counter-clockwise.

To better inform the operator, at least one display can be provided, either in the external control stand and/or in the driver stand in which e.g. the adjusted speed and/or the value of the control current can be displayed when the actuation instrument is being operated.

In a structurally simple embodiment, the actuation instrument embodied as rotary knob is coupled to a rotary potentiometer which permits to continuously vary the control current wherein the control current is suitably converted via corresponding proportional amplifier devices to the actual control current for the respective proportional magnet.

In one suitable embodiment, the actuation instrument comprises an electric switch which comprises at least one Hall sensor and at least one permanent magnet movable relative to the latter, in case of a rotary knob, preferably a Hall sensor stationarily placed on a printed circuit board and a permanent magnet rotatable relative to the Hall sensor by the rotary knob. This solution is suitable if the movement path of the rotary knob is divided into at least two speed ranges.

Corresponding to the modern control principle of road finishing machines, the actuation instrument and the proportional magnet or the proportional amplifier device are designed with bus capability and incorporated in a bus system of the road finishing machine which is guided via the control device of the road finishing machine.

In a fail-safe embodiment that is adapted to the rough working conditions of a road finishing machine and is simple as to its assembly, the rotary knob is mounted in a stationary seat with an axle containing a permanent magnet. The axle preferably consists of paramagnetic stainless steel. The printed circuit board with the stationary Hall sensor is disposed underneath the seat. The seat comprises a sliding bearing for the axle and two double-leg coil springs situated one above the other in the axial direction at a spring retainer. Each double-leg coil spring is supported with one leg at the seat while it is engaged with its other leg with a dog of the rotary knob or can be engaged with it during the movement of the rotary knob. In this manner, at least one spring stage can be realized up to which the kinetic resistance of the rotary knob increases and which then generates the increase in kinetic resistance as of which kinetic resistance can further increase. The switch point of the Hall sensor is suitably adapted to the position of the increase in kinetic resistance.

Suitably, at least one O-ring is furthermore mounted with pretension between the axle and the seat which on the one hand accomplishes a sealing function and on the other hand ensures largely uniform self-locking of the rotary knob.

It is finally suitable for the rotary knob to comprise a knurled cover with a laterally projecting arm. The knurled cover permits an ergonomically advantageous handling of the rotary knob even under aggravated conditions (rain, snow). The arm provides additional orientation for the adjusted rotational position, for example in relation to marks in the control panel disposed about the rotary knob. Moreover, the arm can be employed for defining the zero position and the maximum position, or corresponding stops are provided inside the rotary knob and define the zero position and the maximum position. It will be understood that the rotary knob or its cover can be illuminated, so that the operator can easily localize the actuation instrument for its prompt operation even in unfavorable weather conditions, such as poor visibility or night work.

For details of the proportional valve technology in the screed of a road finishing machine, reference is made to the disclosure in EP 2 325 390 A which is hereby incorporated by reference.

BRIEF SUMMARY OF THE DRAWINGS

With reference to the drawings, embodiments of the subject matter of the invention will be illustrated. In the drawings.

DETAILED DESCRIPTION OF THE INVENTION

Figure 1:
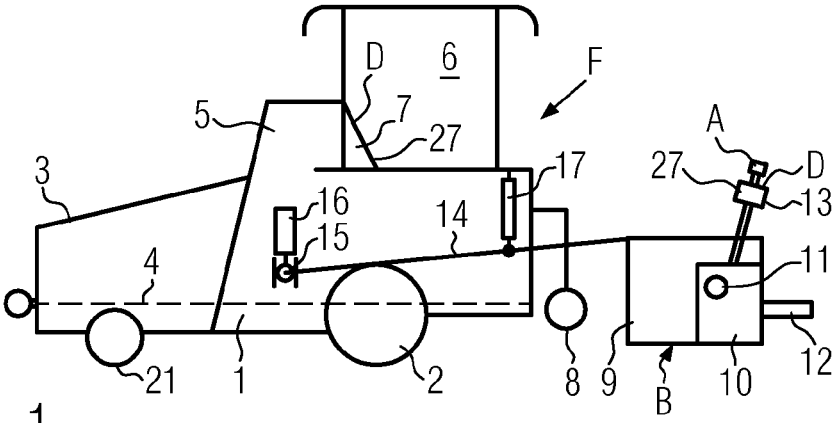
FIG. 1 shows a schematic side view of a road finishing machine with a screed.
Figure 2:
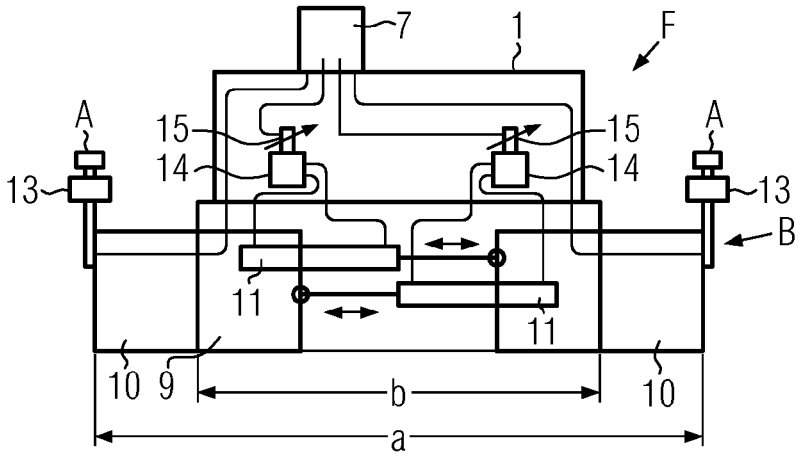
FIG. 2 shows a schematic rear view of the screed and the road finishing machine of FIG. 1.

A road finishing machine F shown in FIGS. 1 and 2 comprises a chassis 1 drivable on wheels 2 at the front of which a paving material bunker 3 is disposed from which an internal longitudinal conveying device 4 leads to the rear end of the chassis 1. Behind the bunker 3, a primary drive unit 5 is arranged, e.g. a diesel engine with a pump transfer gear with hydraulic pumps and a generator (not shown), behind which there is a driver stand 6 with an electronic control device 7 of the road finishing machine. The control device 7 can comprise a display D in a control panel 27. A transverse distribution device 8 is mounted to the rear end of the chassis 1.

For laying at least one surfacing, the road finishing machine F is equipped with at least one towed screed B consisting of a basic screed 9 with a predetermined working width approximately of the width of the chassis 1 and two extendable screed parts 10 which are here mounted at the rear to the basic screed 9 so as to be movable. Each extendable screed part 10 can be hydraulically moved relative to the basic screed 9 by at least one movement actuator 11 to be able to vary the working width a (FIG. 2) of the screed B with respect to the working width b of the basic screed 9. The movement actuators 11 are suitably double-acting hydraulic cylinders which are effectively mounted between the basic screed 9 and each extendable screed part 10. Rear platforms 12 on which an operator can stand can be attached to the screed B or at least to the extendable screed parts 10. Furthermore, an external control stand 13 is externally disposed e.g. at each extendable screed part 10 which comprises a control panel 27, optionally with a display D and at least one actuation instrument A for controlling the shifting motions of the corresponding extendable screed part 10. The actuation instruments A can be redundantly provided also in the control panel 27 of the control device 7 in the road finishing machine and be suitably linked to the control device 7. Moreover, the road finishing machine F can contain a bus system in which electric components of the road finishing machine with bus capability are incorporated.

According to FIG. 2, at least one proportional control valve 14 (e.g. a pilot-controlled or directly actuated multipath-multiposition slide or seat valve) with a proportional magnet 15 is allocated to each movement actuator 11 and connected to the non-depicted hydraulic system (pressure source, tank, and the like) of the road finishing machine F. The proportional magnets 15 are incorporated in the control device 7, suitably via proportional amplifiers, and connected to the actuation instruments A via the control device which permit to adjust or vary the control current for the proportional magnets 15. Each proportional control valve 14 controls the amount of hydraulic oil per time unit, for example load-independently, corresponding to the value of the control current of the proportional magnet 15, the amount defining the speed of the movement actuator 11.

Figure 3:
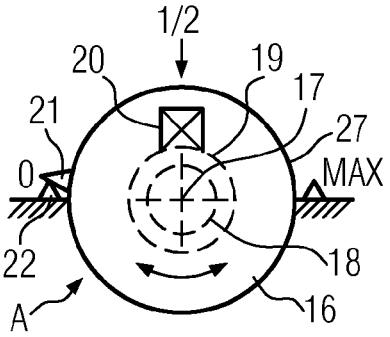
FIG. 3 shows a detail concerning an actuation instrument for controlling the speed of an extendable screed part utilizing proportional valve technology.

FIG. 3 illustrates an embodiment of the actuation instrument A as a rotary knob 16 to which, for example, a rotary potentiometer 18 is coupled for varying the control current. The actuation instrument A can be rotated between a zero position O and a maximum position MAX and comprises, in the embodiment as a rotary knob 16, for example a laterally projecting arm 21 which is movable in the control panel 27 relative to marks provided there and optionally also limits the movement path by means of stops 22. At least one mechanical progressive locking device 20 is incorporated in the actuation instrument A, here the rotary knob 16 of FIG. 3, by means of which locking device here approximately in the middle of the movement path, at least one clearly noticeable increase in kinetic resistance can be generated with an adjusting direction towards the maximum position at a rotational position. As an alternative, several increases in kinetic resistance could be generated to subdivide the movement path into several sections, or the progressive locking device 20 could be embodied such that it generates several locked positions which are each clearly noticeable by the operator when he operates the rotary knob 16 but can be overcome by increasing the handling force. The actuation instrument A is preferably self-locking, so that it automatically maintains each adjusted position.

Figure 4:
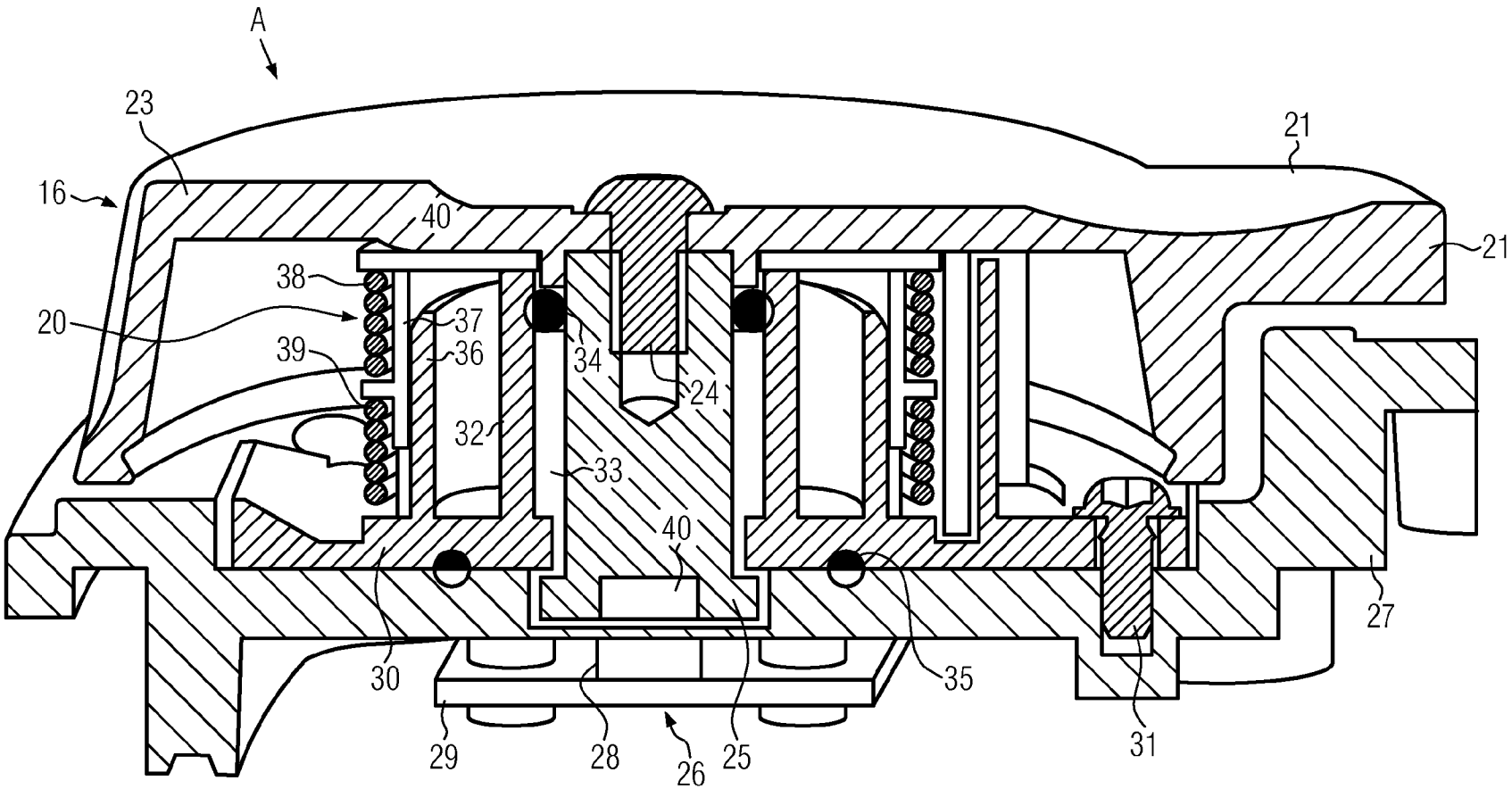
FIG. 4 shows a cross-section of a detail variant of the actuation instrument embodied as rotary knob.

FIG. 4 in a section illustrates a concrete further embodiment of an actuation instrument A embodied as a rotary knob 16. The rotary knob 16 is, for example, disposed in an indentation in the control panel 27 and comprises an optionally illuminated cover 23 which comprises the arm 21 and is connected, via a screw 24, with an axle 25 which preferably consists of paramagnetic stainless steel. The screw 24 can be mounted with a non-depicted lower head seal and a polyamide spot coating as screw locking means. An electric switch 26 is allocated to the rotary knob 16 which, in the shown embodiment, consists of a permanent magnet 40 contained in the axle 25 and a Hall sensor 28 stationarily mounted on a printed circuit board 29 underneath the control panel 27.

The axle 25 is guided to rotate in a sliding bearing 33 contained in a socket piece 32 of a seat 30 stationarily mounted in the control panel 27 with screws 31. Between the socket piece 32, the axle 34, the sliding bearing 33 and the cover 23, at least one O-ring 34 is mounted with pretension which fulfills a sealing function and a self-locking function in the rotary knob 16. Another O-ring 35 can be mounted for sealing between the seat 30 and the bottom of the indentation in the control panel 27.

Outside the socket piece 32, the seat 30 comprises a further, somewhat shorter socket piece 36 on the outer side of which a spring retainer 37 is seated at which two double-leg coil springs 38, 39 situated one behind the other in the axial direction are disposed and which can be secured by a ring disk 40 of a material sliding easily relative to the socket piece 32. The double-leg coil springs 38, 39 are anchored at the seat 30 with one leg each and engage a dog 41 of the cover 23 with the respective other leg, either permanently or depending on the adjustment path of the rotary knob 16. The double-leg coil springs 38, 39 are part of the progressive locking device 20 of the actuation instrument A and here generate, at a predetermined rotational position between the zero position and the maximum position, an increase in kinetic resistance clearly noticeable by the operator (spring stage). The rotational position of the increase in kinetic resistance is suitably coordinated with the switch point of the electric switch 26 such that, when the rotary knob 16 is rotated from the zero position to the position of the increase in kinetic resistance, a first constant control current corresponding to a determined, for example low speed of the movement actuator 11 is generated, and during and after the increase in kinetic resistance, a second constant higher control current is generated which preferably corresponds to the maximum speed of the movement actuator 11. When the rotary knob 16 is returned from the maximum position in the direction towards the zero position, essentially at the same rotational position, a clearly noticeable reduction in kinetic resistance is generated. Suitably, at least one of the double-leg coil springs 38, 39 is mounted in the pretensioned state, so that the kinetic resistance of the rotary knob 16 is noticeable as of the zero position and either remains approximately the same or increases progressively until the noticeable increase in kinetic resistance occurs. The same can apply to the movement range as of the exceeding of the increase in kinetic resistance, i.e. then, kinetic resistance also remains approximately the same or increases progressively until the maximum position is reached. Suitably, self-locking by the O-ring 34 is selected such that the double-leg coil springs 38, 39 cannot overcome the self-locking. The rotational position of the respective increase in kinetic resistance can be adjusted, just as its noticeable strength.

As an alternative, the actuation instrument A could be embodied as a joystick, a slide or a push-button during the operation of which at least once an increase or reduction in kinetic resistance (spring stage) that is clearly noticeable by the operator is generated (not shown).

The invention claimed is:

1. Road finishing machine comprising a screed having at least one hydraulically movable extendable screed part, an electronic control device, and at least one control panel linked to the control device the control panel having a control that can be manually operated by at least one operator of the road finishing machine for adjusting the control current for a proportional magnet of at least one proportional control valve and wherein the control comprises an actuation instrument that is manually movable between a zero position and a maximum position to produce a noticeable increase in kinetic resistance that can be overcome by an increase in the exerted operation force generated at least once within the movement path of the actuation instrument, the increase at least noticeably signaling either reaching a predetermined speed or a transition between two different speeds of the movement actuator of the extendable screed part.

2. Road finishing machine according to claim 1, wherein the actuation instrument comprises at least one mechanical progressive locking device that can be manually overcome in the movement of the instrument.

3. Road finishing machine according to claim 1, wherein the actuation instrument comprises a rotary knob.

4. Road finishing machine according to claim 1, wherein the actuation instrument comprises a member selected from the group consisting of a slide, a joystick or a push-button.

5. Road finishing machine according to claim 1, wherein value and/or position within the movement path of the actuation instrument of the noticeable increase in kinetic resistance can be adjusted.

6. Road finishing machine according to claim 2, wherein the progressive locking device contains, at least two double-leg springs.

7. Road finishing machine according to claim 1, wherein the actuation instrument comprises a self-locking rotary knob.

8. Road finishing machine according to claim 1, wherein a constant control current of a first value, and a constant higher control current of a second value can be adjusted, and wherein the second value corresponds to the maximum speed of the movement actuator.

9. Road finishing machine according to claim 1, wherein the value of the first control current can be varied linearly within the movement path, or according to a predetermined curve.

10. Road finishing machine according to claim 1, which comprises at least one external control stand with a control panel located at the screed, and the actuation instrument is disposed in the control panel of the external control stand and linked to the control device at a driver's stand in the road finishing machine.

11. Road finishing machine according to claim 10, wherein each external control stand is externally disposed at an extendable screed part allocated to the external control stand.

12. Road finishing machine according to claim 11, wherein the directions of motion of the two actuation instruments are each opposed to the maximum positions with respect to the center of the screed in the external control stands.

13. Road finishing machine according to claim 1, which comprises at least one display in the control panel.

14. Road finishing machine according to claim 9, wherein the rotary knob is coupled with a rotary potentiometer.

15. Road finishing machine according to claim 1, wherein the actuation instrument comprises an electric switch comprising at least one Hall sensor and at least one permanent magnet movable relative to the sensor.

16. Road finishing machine according to claim 1 wherein the respective actuation instrument and the proportional control valve are incorporated into a bus system of the road finishing machine that is guided by the control device.

17. Road finishing machine according to claim 15, wherein the rotary knob is mounted in a stationary seat with an axle containing the permanent magnet, the printed circuit board with the Hall sensor being disposed underneath the axle, the seat comprises a sliding bearing for the axle and two double-leg coil springs lying one upon the other in the axial direction at a spring retainer, and each double-leg coil spring is supported with one leg of the double leg coil spring at the seat and is, or can be, engaged with a dog of the rotary knob with the other le of the double leg coil spring g.

18. Road finishing machine according to claim 17, which comprises at least one O-ring mounted with pretension between the axle and the seat.

19. Road finishing machine according to claim 18, wherein the rotary knob comprises a knurled cover with a laterally projecting arm.

* * * * *